US005787605A

United States Patent [19]

Okui et al.

[11] Patent Number: 5,787,605

[45] Date of Patent: Aug. 4, 1998

[54] METHOD OF STORING AND TRANSPORTING GASES

[75] Inventors: Toshiharu Okui, Tama; Yuriko Maeda, Tokyo; Katsumi Kaneko, Ichihara, all of Japan

[73] Assignee: Tokyo Gas Co., Ltd., Tokyo, Japan

[21] Appl. No.: 790,418

[22] Filed: Jan. 30, 1997

[30] Foreign Application Priority Data

Jan. 31, 1996 [JP] Japan ..... 8-037526

[51] Int. Cl.[6] ..... F26B 3/00

[52] U.S. Cl. ..... 314/448; 34/452; 62/46.1

[58] Field of Search ..... 62/46.1, 46.3; 34/448, 452

[56] References Cited

U.S. PATENT DOCUMENTS

| | | | |
|---|---|---|---|
| 2,663,626 | 12/1953 | Spangler | 62/46.3 |
| 3,108,445 | 10/1963 | Portzer et al. | 62/46.3 |
| 3,151,467 | 10/1964 | Cohen et al. | 62/46.3 |
| 4,010,622 | 3/1977 | Etter | 62/46.1 |
| 4,017,252 | 4/1977 | Tallonneau | 62/46.3 |
| 5,473,904 | 12/1995 | Guo et al. | 62/46.1 |

FOREIGN PATENT DOCUMENTS

| | | |
|---|---|---|
| A 49-104213 | 10/1974 | Japan . |
| A 54-135708 | 10/1979 | Japan . |
| A 59-197699 | 11/1984 | Japan . |
| A 4-131598 | 5/1992 | Japan . |
| A 6-55067 | 3/1994 | Japan . |

*Primary Examiner*—Ronald C. Capossela

*Attorney, Agent, or Firm*—Flynn, Thiel, Boutell & Tanis, P.C.

[57] ABSTRACT

A method of storing and transporting gas wherein a large amount of gas is stored and transported by bringing the gas into contact with a porous material having fine pores and a large specific surface area in the presence of a compound serving as a host at or close to room temperature. The method according to the invention enables the gas in an amount equivalent to more than 180 times as much as an unit volume of the porous material to be stored or transported in a short time, even under a low pressure, for example, atmospheric pressure or up to 10.68 atm (equivalent to 10 kg/cm$^2$ by gauge pressure) or less, and furthermore, is applicable to various kinds of gases.

20 Claims, 4 Drawing Sheets

METHOD OF STORING AND TRANSPORTING GASES

BACKGROUND OF THE INVENTION

1. Field of the Invention

The present invention relates to a method of storing and transporting various kinds of gases including natural gas, methane, ethane, and other lower hydrocarbons, and carbon dioxide. More particularly, it relates to a method of storing and transporting these gases through the adsorption thereof in a large quantity onto a porous material at or close to room temperature in a short time.

2. Description of the Prior Art

Gas in a gaseous state has a very large volume and a low specific gravity. Consequently, a means for increasing the density of a gas is highly required in order to improve the storage efficiency and transportation efficiency in storing and transporting gas. There are several methods for achieving such objects as follows:

(1) a method of compressing gas under a high pressure as seen in the case of compressed gas contained in high pressure gas bombs; and (2) a method of cooling and liquefying gas as seen in the case of liquid nitrogen, and liquid oxygen, or liquefied natural gas and the like. Besides the aforesaid methods, various other methods are also proposed as described hereafter under (3)–(7):

(3) COSORB method used for absorption of, for example, carbon monoxide, and a method of absorbing carbon dioxide by an alkali;

(4) a method wherein a gas is adsorbed to the surface of a solid adsorbent such as silica gel, active carbon, and the like (JP-A 49-104213, and JP-A 6-55067);

(5) a method using a hydrogen storage alloy or combinations of a hydrogen storage alloy and an adsorbent (JP-A 4-131598);

(6) a method utilizing a chemical reaction occurring on the surface of a solid substance accompanied by the decomposition of methane (JP-A 59-197699); and (7) a method wherein a hydrocarbon gas containing methane or ethane as a main constituent is brought into contact with water in the presence of an aliphatic amine, thereby utilizing the gas hydrate (JP-A 54-135708).

However, the method referred to under (1) above has a drawback in that the weight of each container becomes very large in comparison with the weight of the gas to be stored therein because sufficient pressure-resistant strength is required of containers. Particularly, in the case of a gas pressure exceeding 10.68 atm (equivalent to 10 kg/cm$^2$ by gauge pressure), materials, facilities, piping, and the like meeting specifications specified under the regulations pertaining to high pressure gas control are required, causing the method to become costly as a result.

In the liquefaction method referred to under (2) above, the gas needs to be compressed, and cooled for the liquefaction thereof, not only resulting in a high cost but also requiring separate and special facilities to keep the liquefied gas cooled. Furthermore, similarly to the method (1) above, this method is subject to regulatory constraints. Under the circumstance, viable application of this method is limited to high-valued helium or liquefied natural gas in which economies of scale can be realized.

Then, in most cases of the method (3) above, a chemical reaction such as an acid-alkali reaction between molecules of a gas to be absorbed and molecules contained in a liquid phase, and the like is utilized. For this reason, there has been great difficulty in controlling the composition of the liquid phase and the reaction process.

In the method (4) above of storing gas through physical adsorption onto the surface of solids, an equilibrium pressure phenomenon is utilized. As a result, its adsorption speed is slow, and appropriate pressurization of the gas is required to obtain a sufficient amount of adsorption. According to this method, gas can be stored at a pressure lower than that for the aforesaid method of storing gas in high pressure cylinders. Still, a pressure at 10.68 atm (equivalent to 10 kg/cm$^2$ by gauge pressure) or higher is normally required.

In the method (5) above, if the gas to be stored is, for example, hydrogen, a hydrogen storage material has to be, for example, palladium metal or its alloy. Thus, a suitable storage material is limited to specific materials on the basis of nearly a one-to-one relationship with the gas to be stored, and further, the cost of the method becomes higher since the storage material is of a special type and expensive. In addition, meticulous care needs to be exercised in handling of the storage material because of a tendency of the embrittlement thereof when used repeatedly.

Similarly to the case of the method (5) above, the method referred to under (6) has a problem in that the kind of gas stored is limited, and a material required for storage is of a special type and expensive.

Then, in the case of the method (7) above, it is of the gas-liquid contact type, and therefore, its effect is largely dependent on the gas-liquid contact efficiency. The method has a problem that the amount of gas actually stored is substantially lower than the amount anticipated on a theoretical basis.

SUMMARY OF THE INVENTION

It is an object of the invention to provide a method of storing and transporting gas for solving various problems described above which are encountered in carrying out the prior art.

Another object of the invention is to provide a method of storing a large volume of gas equivalent to, for example, more than 180 times (on the basis of conversion to the standard state) as much as an unit volume of a material for use in the method under a reduced pressure or a low pressure ranging from the atmospheric pressure to 10.68 atm (equivalent to 10 kg/cm$^2$ by gauge pressure) at or close to room temperature without use of any special material or facilities.

Further object of the invention is to provide a method of transporting a large volume of gas equivalent to, for example, more than 180 times (on the basis of conversion to the standard state) as much as an unit volume of a material for use in the method under a reduced pressure or a low pressure ranging from the atmospheric pressure to 10.68 atm (equivalent to 10 kg/cm$^2$ by gauge pressure) at or close to room temperature without use of any special material or facilities.

Still a further object of the invention is to provide a method of storing and transporting gas which is effectively applicable to various kinds of gases having different molecular diameters.

An additional object of the invention is to provide a method of storing gas wherein a large volume of gas is adsorbed to and stored in a porous material having fine pores and a large specific surface area by bringing the gas in contact therewith in the presence of a compound serving as a host at or close to room temperature.

An even further object of the invention is to provide a method of transporting a gas comprising contacting a gas with a porous material having fine pores and a large specific area at or close to room temperature in the presence of a compound serving as a host, whereby a large amount of the gas is adsorbed to and stored in the porous material, and then transporting the said porous material adsorbed to and stored the gas.

PREFERRED EMBODIMENT OF THE INVENTION

Figure 1:
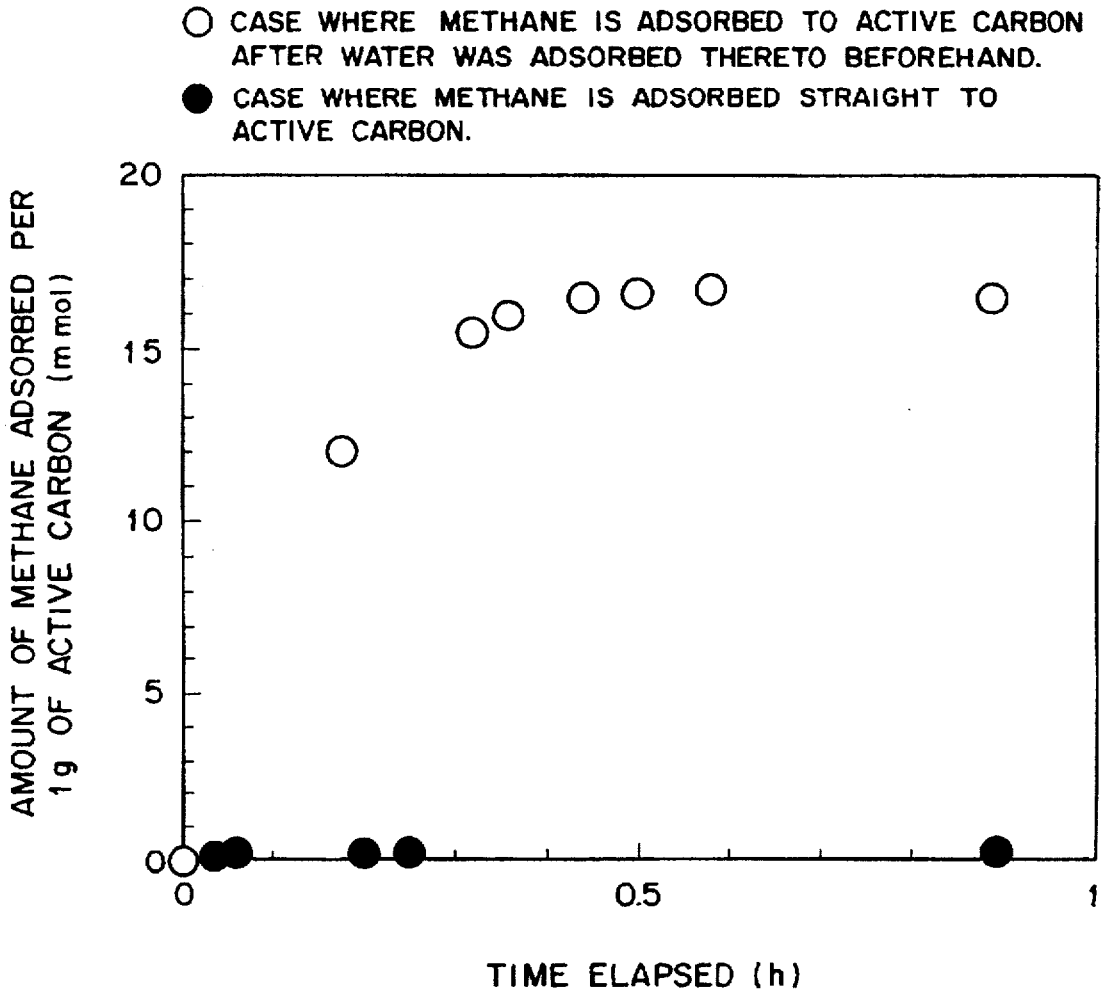
FIG. 1 is a graph showing variation with time in the amount of methane adsorbed to 1 g of the active carbon in the presence of water in comparison with the same when methane was brought straight in contact with the active carbon without presence of water (under 0.2 atm at 30° C.)

A method of storing gas according to the present invention is characterized in that a large amount of gas is brought into contact with a porous material having fine pores and a large specific surface area in the presence of a compound serving as a host at or close to room temperature, thereby causing the gas to be adsorbed to and stored in the porous material.

Also, a method of transporting gas according to the present invention is characterized in that a large amount of gas is brought into contact with the porous material having fine pores and a large specific surface area in the presence of the compound serving as host at or close to room temperature, thereby causing the gas to be adsorbed to the porous material and transported therein.

There is no particular limitation as to the kind of the porous material having fine pores and a large specific surface area for use in the method of storing and transporting gas according to the invention provided that it is a porous material having fine pores and preferably it has a specific surface area of 100 $m^2/g$ or greater. Further, any porous material regardless of its quality, manufacturing method, and shape may be used for the purpose described above provided that it neither react with nor is dissolved into water or a compound, serving as host and having a function similar to water, (in other words, if it is not adversely affected by the compound serving as host through dissolution or chemical reaction in practical application) and there is no need for uniformity in the shape and diameter distribution of fine pores of the porous material.

Any porous materials having the characteristics described above may be used in carrying out the embodiments of the invention. Among them, active carbon and ceramics are particularly suitable for such a purpose as above. The method according to the invention is quite advantageous in that for example, the active carbon and ceramics are cheap and obtainable with ease. Further, as the compound serving as the host used in the method according to the invention, water, alcohols, organic acids, hydrogen sulfide, and the like are cited. Among them, water is particularly preferable. Also, the method of storing and transporting gas according to the invention is applicable to the storage and transportation of various kinds of gases having different molecular diameters.

With the method according to the invention, a large volume of gas equivalent to, for example, more than 180 times (converted to the standard state basis) an unit volume of the porous material can be stored and transported in a short time by bringing gas to be stored into contact with the compound serving as host inside fine pores of the active carbon or ceramics under a moderate condition, that is, at or close to room temperature and under atmospheric pressure or a pressure close thereto.

The method of storing and transporting gas according to the invention is effective not only under a low pressure in the range from atmospheric pressure to 10.68 atm (equivalent to 10 $kg/cm^2$ by gauge pressure) or less but also under a reduced pressure, for example, as low as 0.2 atm. Under a higher pressure in excess of 10.68 atm (equivalent to 10 $kg/cm^2$ by gauge pressure), further massive amounts of gas can be stored and transported corresponding to the pressure.

Thus, the method of storing and transporting gas according to the invention does not require either any special cooling equipment or any special pressurizing facilities, making it quite effective from a practical viewpoint.

Then, as for the active carbon, it is easily available in powder form, granular form, fiber form, or various other forms having fine pores in various diameters and large specific surface areas. Furthermore, the diameter distribution of fine pores and the specific surface area of the active carbon can be easily confirmed by measuring the amount of nitrogen adsorbed at the liquid nitrogen temperature and an adsorption isotherm.

As the substance of the active carbon has a very large specific surface area, a large number of gas molecules can be adsorbed to the surface thereof. Most of the gas molecules thus adsorbed can be caused to remain exposed on the inner surface of fine pores by controlling the amount of the gas adsorbed.

The fine pores of the substance are sufficiently small in diameter ranging from, for example, several nm to several tens nm, and as a result, the gas molecules adsorbed on the inner surface of the fine pores behave as if they were under a high pressure condition. Such behavior represents a phenomenon known as the quasi-high pressure effect.

As described above, phase transition, reaction, and the like that occur normally only under a high pressure can occasionally happen under a moderate condition of lower pressure and lower temperature by use of a porous material having fine pores. The effect of the method according to the invention is presumably attributable to such a phenomenon as described above among other factors although the cause thereof is not known in detail.

As for "a host compound" used in practicing the invention, there is no specific limitation provided that it is a compound that can form a certain structure through hydrogen bonding when several molecules thereof cluster. As described in the foregoing, water, alcohols, organic acids, hydrogen sulfide, and the like are cited as the host compound. Among them, water is used as a preferable compound.

When any of the aforesaid host compounds coexists with gas molecules (referred to as "guest molecules") having dimensions in a certain range, clathrates are formed, causing the gas molecules to be crystallized in very close proximity to each other and stabilized. This is a phenomenon wherein the host compound coexisting with the gas molecules serving as guest under a condition of a specific pressure and temperature forms jointly with the gas molecules, through hydrogen bonds, specific cubic structures, for example, cage-like structures in which the guest molecules are surrounded by the host molecules, and such clathrates are normally formed under a condition of low temperature and high pressure.

In contrast thereto, the method according to the invention enables a large volume of gas to be stored rapidly, even under a moderate condition without need for high pressure through combination of a high adsorbing capacity of the porous material having fine pores, the aforesaid quasi-high pressure effect inside the fine pores, and the characteristic of the clathrates containing gas.

Furthermore, with respect to the gas storage capacity obtained in the method according to the invention, the ratio of the number of guest molecules to that of host molecules far exceeds the same obtained for any clathrates known thus far. Such a phenomenon as described above can not be explained by any known theory pertaining to the formation of clathrates alone. It appears that some synergistic effects due to the combination of the porous material having fine pores and clathrates, that is, an effective and excellent gas storage action according to some new and beneficial theory has occurred.

The method of storing and transporting gas according to the invention is practiced by embodiments thereof as described hereafter under (1)~(3), by way of example. However, various embodiments other than the aforesaid may be carried out provided that the theory on which the present invention is based is applied to them:

(1) The porous material is placed in a vessel first, then the host compounds are fed into a vessel, and caused to be adsorbed to the porous material. Thereafter, a storage gas (a gas to be stored) or a transportation as (a gas to be transported) is fed into the vessel.

(2) The porous material to which the host compound has already been adsorbed is placed in a vessel, and then the storage gas or the transportation gas is fed into the vessel.

(3) The porous material is placed in a vessel first, and then a mixture of the host compound and the storage gas or the transportation gas is fed into the vessel.

The term "gas" as used herein is not limited to a single kind of gas but, intended to include a mixture of two or more kinds of gases, for example, natural gas and other another gas.

In any of the embodiments of the invention described in the foregoing, high pressure vessels are not required for use as special vessels because the gas can be adsorbed to the porous material and stored at a low pressure. Still, high pressure vessels may naturally be used as well without causing any problem, and it is possible to store and transport gas under a higher pressure, for example, in excess of 10.68 atm (equivalent to 10 kg/cm$^2$ by gauge pressure), in the same way as the method of storing and transporting gas according to the invention, in which case high pressure vessels capable of withstanding such a high pressure are used.

The same can be said of the cases where natural gas, methane, ethane, ethylene, propane, butane, and other lower hydrocarbons, and carbon dioxide, and the like are stored, and transported in vessels by the method according to the invention.

By the method of storing and transporting gas according to the invention, a large amount of gas can be stored and transported using the porous material and the host compound, which are available cheaply, without need for special cooling equipment.

Further, the method according to the invention enables a large amount of gas to be stored or transported in a short time at or close to room temperature under a reduced pressure, or a low pressure ranging from atmospheric pressure to 10.68 atm (equivalent to 10 kg/cm$^2$ by gauge pressure) or less and is quite advantageous in practical application because it does not require, for example, any special pressure vessels and the like as required in the conventional methods.

In addition, the method is not only more efficient in respect of its storage effects under a pressurized condition ranging from 15 to 20 atm or higher but also applicable to the storage and transportation of various kinds of gases having different molecular diameters as well as such hydrocarbons as methane, ethane, ethylene, propane, butane, and the like or a gas in great demand such as natural gas and the like.

The invention will be understood more readily with reference to the following examples, however, these examples are intended to illustrate preferred embodiments of the invention and are not to be construed to limit the scope of the invention. The schematic illustration of the testing apparatus used in carrying out the examples is described first, followed by specific results of adsorption tests conducted using the testing apparatus.

Figure 4:
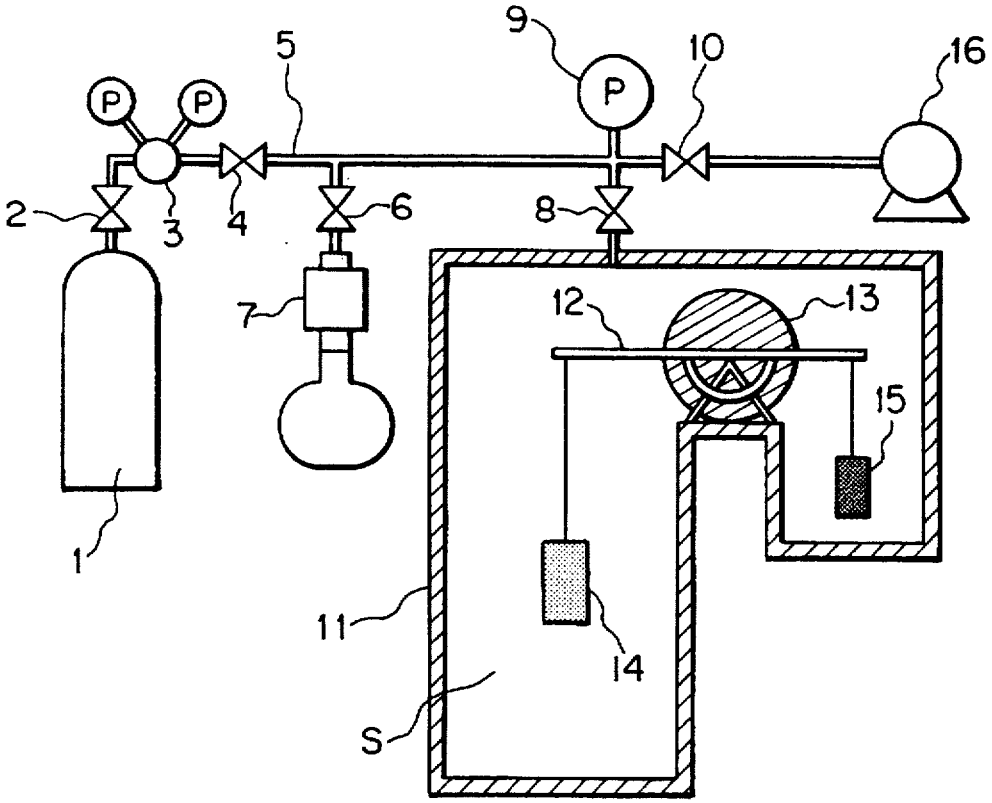
FIG. 4 illustrates in principle the constitution of a testing apparatus used in carrying out the examples.

FIG. 4 illustrates in principle the constitution of the testing apparatus used in carrying out the examples. In FIG. 4, numeral 1 is a high pressure cylinder for a gas to be adsorbed, numerals 2, 4, 6, 8, and 10 are valves, 3 a regulator, 5 a gas pipe, 7 a water vapor generator, and 9 a pressure gauge. Then, numeral 11 is a pressure vessel, 12 a beam balance, 13 a mechanism for detecting downward displacement of one end of the beam of the beam balance 12 and correcting such downward displacement by electromagnetic force, 14 a material to which the gas adsorbs, 15 a reference weight (to which the gas does not adsorb), and 16 a vacuum pump.

When operating the testing apparatus, firstly, air was evacuated from the pressure vessel 11 and the gas pipe 5 by use of the vacuum pump 16, and then water was caused to adsorb to a sample 14 (gas adsorption material). The procedure for the adsorption of water is described hereafter. Water vapor generated by the water vapor generator 7 was fed into the pressure vessel 11 via the gas pipe 5 by opening the valve 6, forming a saturated water vapor atmosphere (for example, a water vapor atmosphere under 0.04 atm at 30° C.) therein and causing water to be adsorbed sufficiently to the sample 14.

Thereafter, a predetermined water vapor atmosphere was formed by adequately reducing the pressure further with the vacuum pump 16, removing excess water adsorbed. Then, the inside of the gas pipe 5 was sufficiently decompressed after closing the valves 4 and 8, removing moisture inside the gas pipe 5 completely. Thereafter, the gas was adsorbed to the sample 14 prepared as above.

A gas atmosphere S under a predetermined pressure was formed inside the pressure vessel 11 by feeding the gas to be adsorbed from the high pressure cylinder 1 into the testing apparatus while strictly controlling the feed rate with the regulator 3. Accurate measurement of the amount of water and the gas that was adsorbed to the sample 14 was accomplished by use of a method whereby the amount of water and the gas, respectively, adsorbed to the sample 14 is calculated from the quantity of electricity consumed to keep the beam of the beam balance 12 horizontal by the agency of electromagnetic force acting against a tendency of one end of the beam, on the side of the sample 14, being displaced downward due to an increase in the weight of the sample 14 after adsorption thereto of water and the gas. The temperature of the aforesaid atmosphere was kept constant by housing the testing apparatus completely in a thermostat (not shown in FIG. 4).

EXAMPLE I

A test was conducted wherein after 0.0083 g of water was adsorbed to 0.0320 g (0.0461 cc) of pitch type active carbon having 1765 $m^2/g$ of specific surface area, 1.13 nm (nanometer) in the average diameter of its pores, 0.971 cc/g in the average volume of its pores, 2.13 g/cc of intrinsic specific gravity, and 0.694 g/cc of apparent specific gravity, methane gas under 0.2 atm at 30 ° C. was fed into the testing apparatus. For the purpose of comparison, another test was conducted wherein the methane gas was fed under the same condition except that water was not adsorbed to the active carbon beforehand.

FIG. 1 illustrates the variation with time in the weight of methane gas adsorbed to 1 g of the active carbon during the course of the aforesaid tests. In FIG. 1, the variation in the weight of the methane gas adsorbed when water was adsorbed to the active carbon prior to the methane gas being adsorbed thereto is plotted with blank circles whereas the same when methane gas was adsorbed straight to the active carbon is plotted with solid circles.

As shown in FIG. 1, when water was adsorbed to the active carbon first and then the methane gas was fed thereto, the active carbon started to store the methane gas henceforth at a rapid rate with the amount of the methane gas adsorbed after the elapse of 0.2 hr . . . reaching more than 15 mmol per 1 g of the active carbon and the same after the elapse of 0.5 hr. reaching around 17 mmol per 1 g of the active carbon, which was maintained thereafter. Considering the fact that the methane gas fed at this point in time was pressurized at 0.2 atm (at 30° C.), it can be said that the rate at which the methane gas is adsorbed and the amount of the methane gas adsorbed in the method according to the present invention are superior to the same for the conventional methods.

On the other hand, when the methane gas was fed without water being adsorbed to the active carbon beforehand as in the conventional methods, only a minimal amount of the methane gas was adsorbed without showing any change in the amount of the methane gas adsorbed after the elapse of time under the same atmosphere as described above. In other methods, for example, the method referred to in JP-A 9-104213, silica gel, molecular sieves, active carbon, and the like are placed in a pressure tank first, and methane gas is stored by applying pressure at around 68 atm (equivalent to 1000 psia). In application of this technique, such a high-pressure operation is indispensable even using similar adsorbents described above.

Table 1 shows the results of a comparison of the amounts of methane adsorbed per 1 g of the active carbon as shown in FIG. 1. According to Table 1, the amount of methane adsorbed was only 0.18 mmol after the elapse of 0.2 hr. in the case of methane being adsorbed straight to the active carbon whereas the same was 12.08 mmol in the case of methane being adsorbed to the active carbon in the presence of water fed thereto beforehand, 67 times as much as the former case. After the elapse of 0.9 hr., the amount of methane adsorbed to the active carbon in the case of water coexisting with methane was 16.46 mmol, 91 times as much as the same in the case of methane being adsorbed straight to the active carbon, that is, 0.18 mmol.

TABLE 1

| | Amount of methane adsorbed per 1 g of the active carbon (mmol) | | |
|---|---|---|---|
| Time Elapsed (h) | Methane adsorbed to the active carbon after water was adsorbed (A) | Methane adsorbed straight to the active carbon (B) | Ratio (A/B) |
| 0.2 | 12.08 | 0.18 | 67.1 |
| 0.9 | 16.46 | 0.18 | 91.4 |

The volume of methane adsorbed to 1 cc in an apparent volume of the active carbon in the presence of water is calculated at 183 cc on the standard state basis under 1 atm at 0° C. This result shows that methane in a volume exactly 183 times, on the standard state basis, as large as an unit volume of the active carbon was stored in the active carbon under a pressure as low as only 0.2 atm. Then (after the elapse of 0.9 hr.), the amount of methane adsorbed was found to reduce slightly, and finally reached 11.77 mmol, at which a state of equilibrium was achieved without any change thereafter.

EXAMPLE II

After 0.0083 g of water was adsorbed first to 0.320 g (0.0461 cc) of the same kind of active carbon as used in Example I, methane gas pressurized at 0~20 atm, respectively, at 30° C. was fed to the testing apparatus, and the amounts of methane gas adsorbed after a state of equilibrium was reached at respective pressures were measured.

Figure 2:
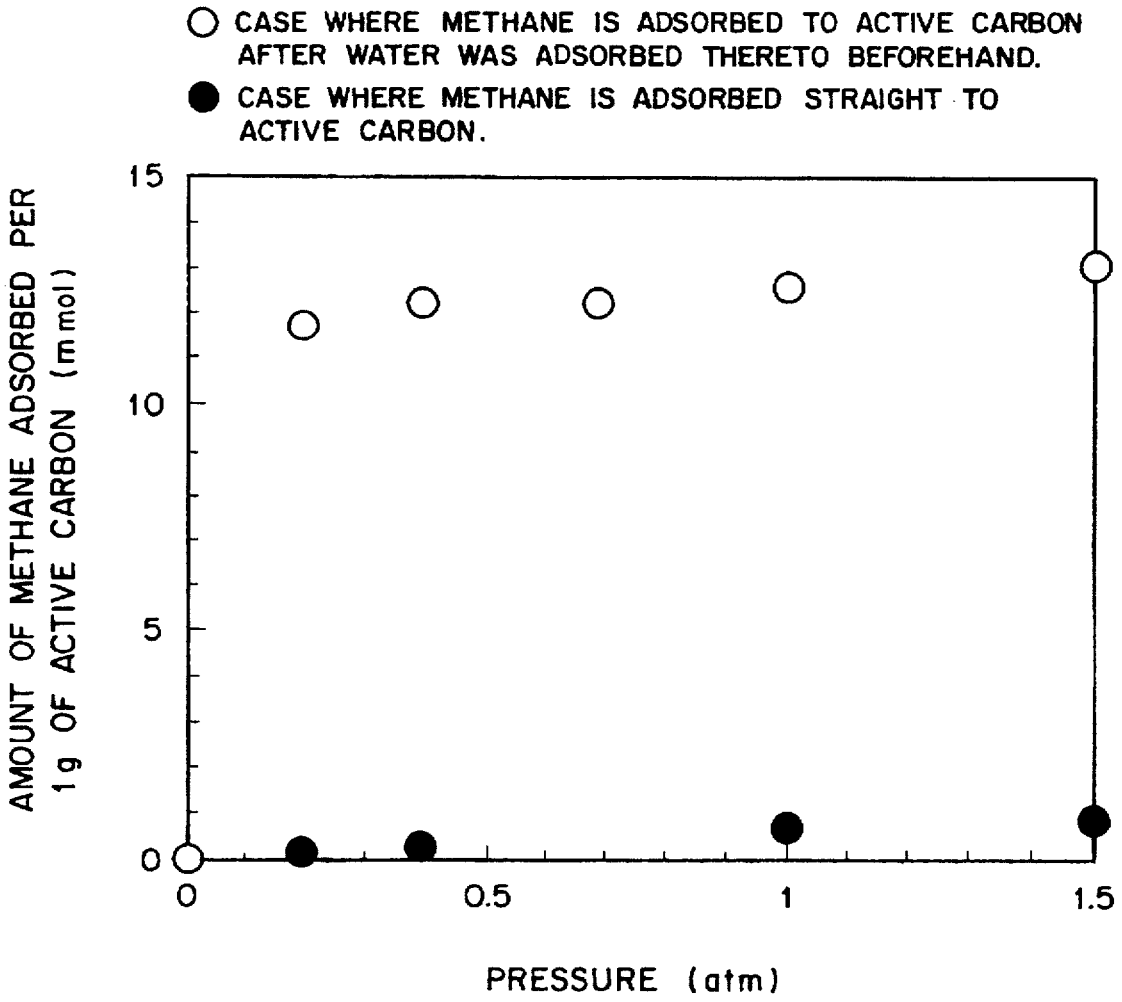
FIG. 2 is a graph showing variation under various pressures in the amount of methane adsorbed to 1 g of the active carbon, comparing the case of testing conducted in the presence of water with the case of methane being brought straight in contact with the active carbon (at 30° C.)
Figure 3:
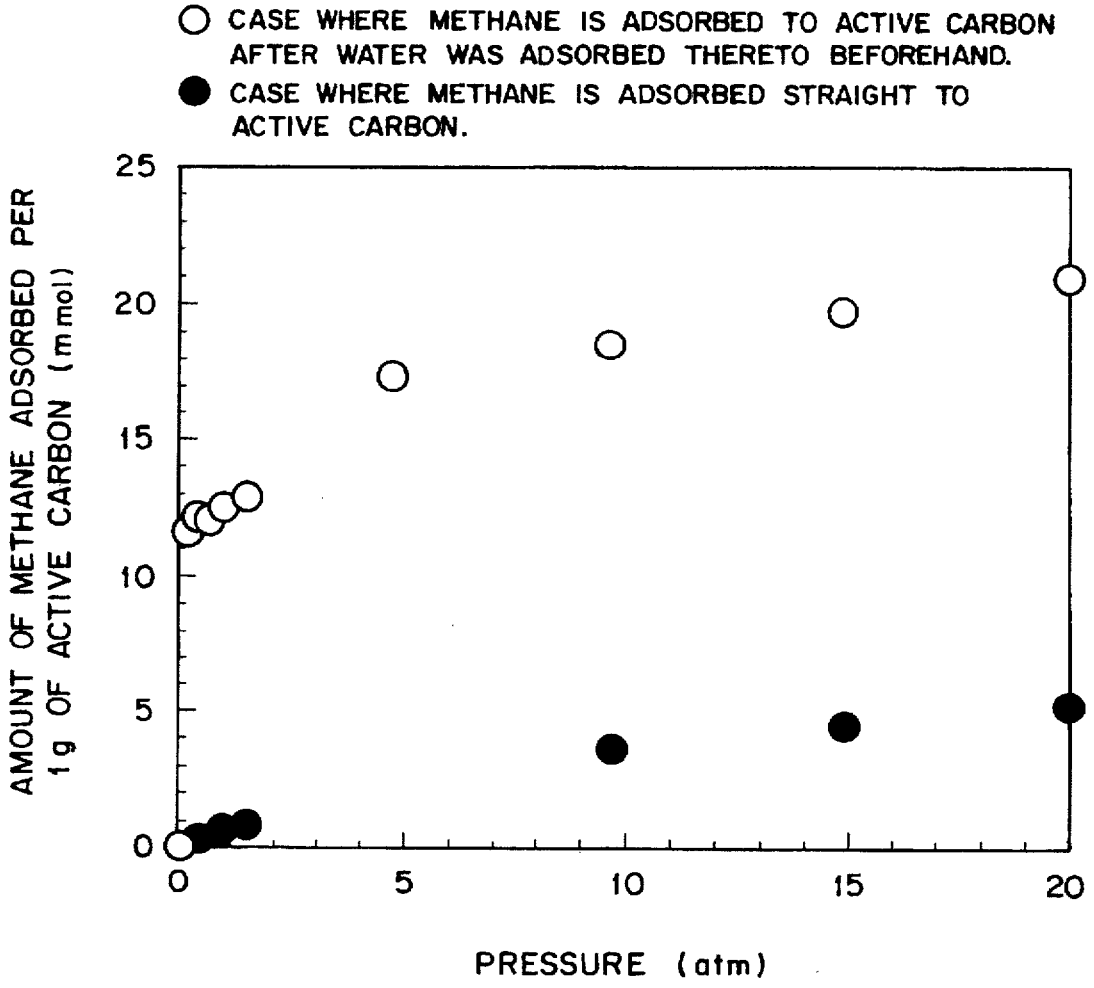
FIG. 3 is similar to FIG. 2 except that a wider range of pressure variation is covered therein.

FIGS. 2 and 3 show the results of these tests. FIG. 2 shows the variation in the amount of methane gas adsorbed under a pressure in the range from 0 to 1.5 atm, among 0~20 atm, enlarged along the horizontal axis. In the figures, the variation in the weight of methane adsorbed when water was adsorbed to the active carbon beforehand is plotted with blank circles whereas the same when methane was adsorbed straight to the active carbon is plotted with solid circles.

As shown in FIG. 2, in the case of methane gas being fed after water is adsorbed to the active carbon beforehand, methane is rapidly stored henceforth even under a very low pressure, indicating the amount of methane adsorbed under 1 atm at around 12 mmol. The figure further indicates that in the case of methane gas being fed after water was adsorbed to the active carbon beforehand, as much as 13 mmol of methane per 1 g of the active carbon was stored under 1.5 atm as against 1 mmol of methane adsorbed per 1 g of the active carbon under the same 1.5 atm in case of the methane being adsorbed straight to the active carbon.

Table 2 shows the results of the comparison of the amounts of methane adsorbed per 1 g of the active carbon as shown in FIG. 2. According to Table 2, in comparing the amounts of methane adsorbed when a state of equilibrium was reached, for example, under 0.2 atm, an the amount of methane adsorbed in the presence of water was 11.77 mmol as against the same of only 0.18 mmol when methane was adsorbed straight to the active carbon, representing a ratio of the former to the latter at 65. Further, in comparing the amounts of methane adsorbed when a state of equilibrium was reached under 1.5 atm, an amount of methane adsorbed in the presence of water was 13.08 mmol as against the same of only 0.88 mmol when methane was adsorbed straight to the active carbon, representing the ratio at 15.

TABLE 2

| Pressure (atm) | Amount of methane adsorbed per 1 g of the active carbon (mmol): Methane adsorbed to the active carbon after water was adsorbed (A) | Methane adsorbed straight to the active carbon (B) | Ratio (A/B) |
|---|---|---|---|
| 0.2 | 11.77 | 0.18 | 65.4 |
| 1.5 | 13.08 | 0.88 | 14.9 |

FIG. 3 is a graph showing the results of measuring the amounts of methane adsorbed when methane was brought into contact with the active carbon under a pressure higher than the pressure condition in FIG. 2, wherein data under a pressure condition up to 1.5 atm as shown in FIG. 2 are plotted as well. As is evident from FIG. 3, the amount of methane stored in the presence of water gradually increased along with an increase in the pressure of methane under 1.5 atm and higher, reaching as much as 21 mmol per 1 g of the active carbon under 20 atm.

On the other hand, when methane was adsorbed straight to the active carbon, an the amount of methane adsorbed increased only by a slight increment, reaching only around 5 mmol even under 20 atm. Further, the amount of methane pressurized only at 1 atm and adsorbed to the active carbon in coexistence with water was found to be as much as 12 mmol per 1 g of the active carbon, which is more than twice as much as the amount of methane adsorbed (about 5 mmol) under 20 atm when methane was adsorbed straight to the active carbon without water coexisting.

Then, volumes of methane adsorbed to 1 cc of the active carbon under various pressures according to FIG. 3, converted to respective volumes on the standard state basis, are equivalent to 191 cc under 0.7 atm, 203 cc under 1.5 atm, 271 cc under 5.0 atm, 290 cc under 10 atm, and 326 cc under 20 atm, respectively, provided that methane is adsorbed to the active carbon after water has been adsorbed to the active carbon. The foregoing description demonstrates that the present invention not only has an excellent capability of adsorbing and storing gas under a condition of reduced pressure or low pressure ranging from atmospheric pressure to, for example, 5 atm, but also is more effective under a pressurized condition, for example, under 10 atm, or 20 atm or even higher.

What is claimed is:

1. A method of storing a gas comprising the steps of:

providing a porous material having a plurality of fine pores and a large specific surface area; and contacting the porous material with the gas in the presence of a compound which can serve as a host for the gas to adsorb and store the gas in the porous material.

2. A method of storing a gas according to claim 1, wherein the porous material is active carbon.

3. A method of storing a gas according to claim 1, wherein the compound serving as host is water.

4. A method of storing a gas according to claim 1, wherein the gas is a lower hydrocarbon.

5. A method of storing a gas according to claim 1, wherein the gas is natural gas.

6. The method of claim 1, wherein the gas is contacted with the porous material at about room temperature.

7. The method of claim 1, wherein the porous material has a specific surface area of at least 100 $m^2/g$.

8. The method of claim 1, wherein the gas is contacted with the porous material at a pressure of from atmospheric pressure to 10.68 atm.

9. The method of claim 1, wherein the porous material is contacted with the host compound prior to the gas contacting the porous material.

10. The method of claim 1, wherein the porous material is contacted with the host compound simultaneously with the gas contacting the porous material.

11. A method of transporting a gas comprising the steps of:

providing a porous material having a plurality of fine pores and a large specific surface area;

contacting the porous material with the gas in the presence of a compound which can serve as a host for the gas to adsorb and store the gas in the porous material; and transporting the porous material containing the stored gas.

12. A method of transporting a gas according to claim 11, wherein the porous material is active carbon.

13. A method of transporting a gas according to claim 11, wherein the compound serving as host is water.

14. A method of transporting a gas according to claim 11, wherein the gas is a lower hydrocarbon.

15. A method of transporting a gas according to claim 11, wherein the gas is natural gas.

16. The method of claim 11, wherein the gas is contacted with the porous material at about room temperature.

17. The method of claim 11, wherein the porous material has a specific surface area of at least 100 $m^2/g$.

18. The method of claim 11, wherein the gas is contacted with the porous material at a pressure of from atmospheric pressure to 10.68 atm.

19. The method of claim 11, wherein the porous material is contacted with the host compound prior to the gas contacting the porous material.

20. The method of claim 11, wherein the porous material is contacted with the host compound simultaneously with the gas contacting the porous material.

* * * * *